US008628148B2

(12) United States Patent
Sulosky

(10) Patent No.: US 8,628,148 B2
(45) Date of Patent: Jan. 14, 2014

(54) HOLDER BLOCK ASSEMBLY FOR A CUTTING TOOL HAVING A HYDRAULIC PISTON AND METHOD

(75) Inventor: William P. Sulosky, Davidsville, PA (US)

(73) Assignee: ESCO Windber Inc., Windber, PA (US)

( * ) Notice: Subject to any disclaimer, the term of this patent is extended or adjusted under 35 U.S.C. 154(b) by 103 days.

(21) Appl. No.: 13/201,902

(22) PCT Filed: Dec. 17, 2010

(86) PCT No.: PCT/US2010/060940

§ 371 (c)(1),
(2), (4) Date: Aug. 17, 2011

(87) PCT Pub. No.: WO2012/082136

PCT Pub. Date: Jun. 21, 2012

(65) Prior Publication Data

US 2012/0223568 A1 Sep. 6, 2012

(51) Int. Cl.
*E21C 35/19* (2006.01)

(52) U.S. Cl.
USPC ..... 299/104; 299/106

(58) Field of Classification Search
USPC ..... 299/104, 106, 107, 110; 29/700, 426.2
See application file for complete search history.

(56) References Cited

U.S. PATENT DOCUMENTS

| | | | | |
|---|---|---|---|---|
| 5,092,660 | A * | 3/1992 | Steinkuhl et al. | 299/103 |
| 5,738,415 | A * | 4/1998 | Parrott | 299/104 |
| 7,648,210 | B2 * | 1/2010 | Hall et al. | 299/104 |
| 2008/0036277 | A1 | 2/2008 | Hall | |

FOREIGN PATENT DOCUMENTS

| | | | |
|---|---|---|---|
| EP | 0997610 | A1 | 5/2005 |
| WO | 9839553 | A1 | 9/1998 |
| WO | 0123708 | A1 | 5/2001 |
| WO | WO 2012155163 | A2 * | 11/2012 |

OTHER PUBLICATIONS

International Search Report issued by the Korean Patent Office in corresponding PCT application PCT/US10/60940, Aug. 2, 2011, 12 pages.

* cited by examiner

*Primary Examiner* — David Bagnell
*Assistant Examiner* — Michael Goodwin
(74) *Attorney, Agent, or Firm* — Steven P. Schad

(57) ABSTRACT

A holder block assembly for a drum-type cutting tool has a holder block, a sleeve, and a piston carried in a piston channel formed in the holder block. The sleeve includes a shank and an enlarged flange at an end of the shank. The sleeve shank is received in a hole in the holder block, with the shank and hole wall forming a number of axially spaced interference fits. A source of pressurized fluid applied to the holder block forces the piston against the sleeve to extract the sleeve from the holder block. Sealing structure between the piston and the holder block prevents the release of hydraulic fluid when the sleeve is released.

19 Claims, 2 Drawing Sheets

HOLDER BLOCK ASSEMBLY FOR A CUTTING TOOL HAVING A HYDRAULIC PISTON AND METHOD

FIELD OF THE INVENTION

The invention relates to cutting tools used with drum-type cutters and the like, and in particular to a cutting tool having a cutter bit removably held in a sleeve, the sleeve removably held in a holder block.

BACKGROUND OF THE INVENTION

U.S. Pat. No. 5,738,415 discloses a cutting tool that has a holder block assembly that includes a holder block and a sleeve removably mounted in the holder block for holding a cutter bit. The sleeve has a shank that is received in a hole in the holder block that extends along an axis. An interference fit between the outer surface of the shank and the wall of the holder block hole resists rotation of the sleeve when held in the holder block.

The outer surface of the shank and the holder block wall each has a larger diameter portion and a smaller diameter portion that extend axially along the axis and are separated by a transition area. The transition area is generally shaped as a conical frustum (that is, shaped as a truncated cone). A hydraulic line extends into the holder block and discharges into the transition area.

To remove the sleeve from the holder block, the hydraulic line is connected to a source of pressurized hydraulic fluid. The fluid exerts an axial force on the sleeve that axially displaces the sleeve with respect to the holder block.

The hydraulic system disclosed in the '415 patent works well to readily and quickly extract the sleeve from the holder block, but it does have disadvantages. The sleeve must move axially the entire distance of the larger diameter portion to extract itself from the holder block. When the sleeve is extracted, hydraulic fluid is released from the holder block. The released fluid may require cleanup or containment.

Thus there is a need for an improved holder block assembly that enables the sleeve to be extracted from the holder block with relatively short axial movement of the sleeve relative to the holder block, and without the release of hydraulic fluid.

BRIEF SUMMARY OF THE INVENTION

The invention is to an improved holder block assembly that enables the sleeve to be extracted from the holder block with relatively short axial movement of the sleeve relative to the holder block, and without the release of hydraulic fluid.

A holder block assembly in accordance with the present invention includes a holder block, a sleeve, and a piston. The holder block includes a first hole extending along an axis, a wall surrounding the first hole, a piston channel, and a bore in fluid communication with the piston channel. The first hole is configured to receive the sleeve.

The sleeve includes a shank that is received in the first hole and a second hole for receiving a cutter bit.

The sleeve and the holder block each include a peripheral surface facing the other of the sleeve and the holding block when the holder block receives the sleeve. The piston channel has an opening in the peripheral surface of the holder block and extends axially inwardly into the holder block to an end of the piston channel.

The piston is in the piston channel and is axially movable in the piston channel. The holder block bore is in fluid communication with the end of the piston channel wherein when a source of pressurized hydraulic fluid is applied to the end of the piston channel through the bore, the fluid pressure urges the piston away from the end of the piston bore to engage the sleeve and push the sleeve out of the holder block.

In preferred embodiments of the invention the sleeve shank and the holder block wall each have a number of axially adjacent surface sections that each have an axial length and become successively smaller in cross-section. The surface sections of the wall cooperate with the surface sections of the shank to generate interference fits between them that retain the sleeve in the holder block.

The axial length of the piston is greater than the axial length of any of the surface sections so that the piston remains in the piston channel when the piston moves the sleeve sufficiently out of the holder block to captured in the piston channel when the sleeve has moved sufficiently to release the interference fits.

Sealing structure between the piston and the holder block form a substantially fluid-tight seal that prevents the release of hydraulic fluid when the sleeve disengages from the holder block.

The holder block assembly of the present invention has a number of advantages. It can be economically manufactured, and works well to readily and quickly extract the sleeve from the holder block with only a relatively small displacement of the sleeve and without the release of hydraulic fluid.

Other objects and features of the invention will become apparent as the description proceeds, especially when taken in conjunction with the accompanying drawing sheet illustrating an embodiment of the invention.

DESCRIPTION OF THE PREFERRED EMBODIMENT

Figure 1:
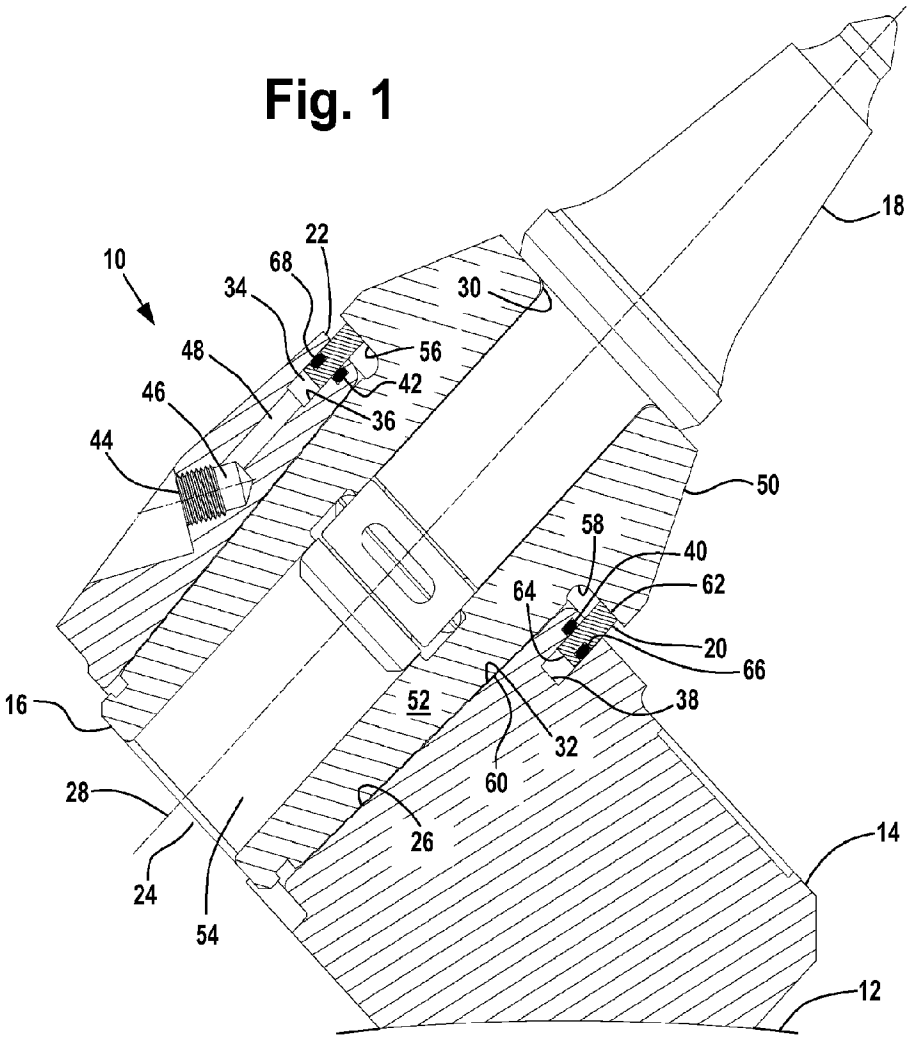
FIG. 1 is a vertical sectional view of a holder block assembly in accordance with the present invention, the holder block assembly attached to a cutting drum of a mining machine.
Figure 2:
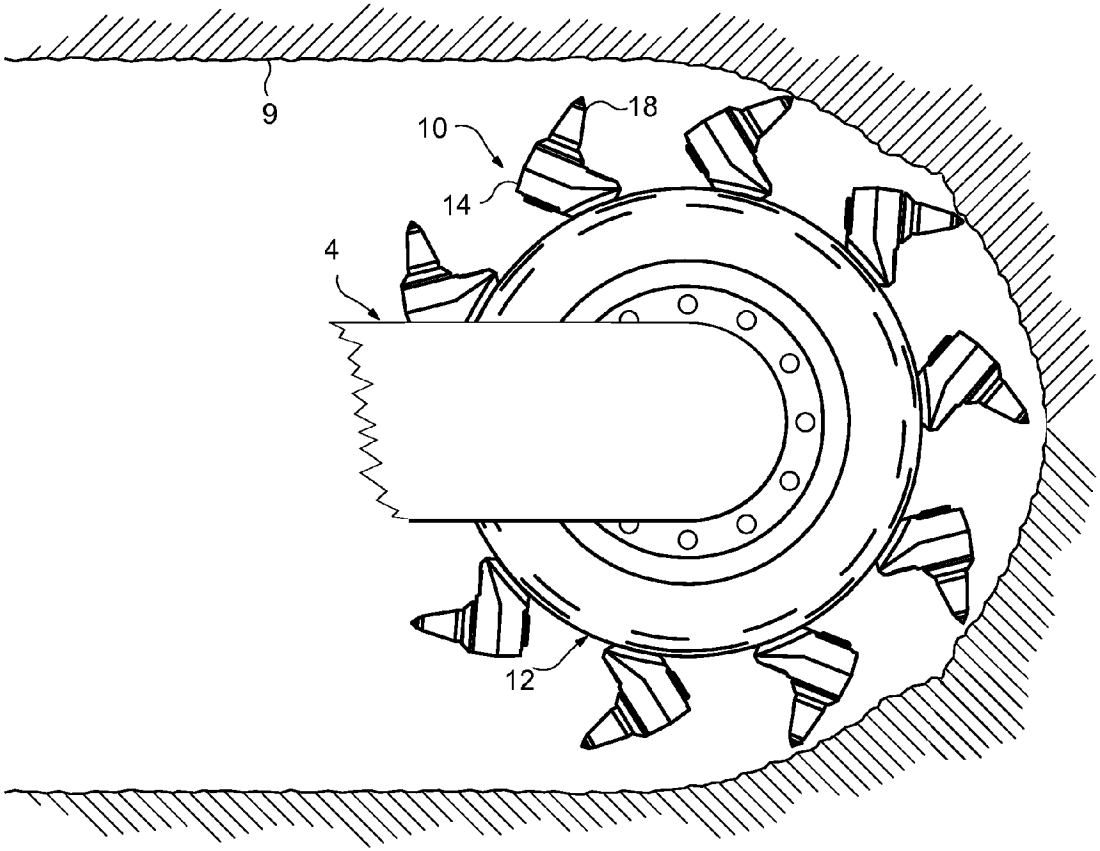
FIG. 2 is a depiction of an earth working operation including a drum with holder block assemblies attached to a support of a mining machine.

FIGS. 1 and 2 illustrate a holder block assembly 10 in accordance with the present invention mounted on a cutting drum 12 of a cutting machine, such as a mining machine 4 used in coal mining. The cutting drum 12 carries a number of like holder block assemblies 10 for impacting the ore seam or earthen material 9 as drum 12 rotates. Block assemblies 10 are arranged on the outer periphery of the drum 12 as is known in the art, but for clarity only one assembly 10 is illustrated in FIG. 1.

The holder block assembly 10 includes a holder block 14 and a sleeve 16 that is received in the holder block 14. The sleeve 16 is shown carrying a conventional cutter bit 18. A piston 20 is installed in the holder block 14.

The holder block 14 has an outer flat periphery wall or surface 22 and a hole 24 defined by a hole wall 26. The hole wall 26 extends into the holder block 14 along an axis 28 perpendicular to the surface 22. The hole wall 26 extends from surface 22 and includes a number of axially adjacent surface sections 32 that each have an axial length and become successively smaller in cross-section in a direction away from the the surface 22.

An annular piston channel 34 defined by a channel wall 36 extends axially inwardly into the holder block 14 from the surface 22 to a blind or closed channel end 38. The piston channel 34 is centered about the axis 28 and is concentric with the hole 24. An O-ring groove 40 is formed in one side of the wall 36 and holds an O-ring 42 facing the piston channel 34.

A flow line or bore 44 extends inwardly into the holder block 14 and discharges into the piston channel 34 at the closed channel end 38. The bore 44 includes an inlet portion 46 that is internally threaded for connection to a supply of pressurized fluid (not shown) and a discharge portion 48 that opens into the piston channel 34 and is parallel with the axis 28.

The sleeve 16 has an enlarged flange 50, a shank 52 extending axially from the flange 50, and a hole 54 extending through the sleeve 16 to hold the cutter bit 18. The flange 50 has a generally flat rear shoulder or surface 56 that butts against and overlays the holder block peripheral wall 22 and locates the sleeve 16 against the holder block 14 when the holder block assembly 10 is assembled. The shank 52 extends from a forward end 58 adjacent the flange 50 and includes a number of axially adjacent surface sections 60 that each have an axial length and become successively smaller in cross-section in a direction away from the shank end 58.

The piston 20 is an annular, circular piston that is closely received without radial interference in the piston channel 34. The piston 20 has parallel upper and lower end piston ends 62, 64 separated by the axial length of the piston 20. The length of the piston 20 is slightly less than the axial depth of the piston channel 34; the upper piston end 62 can be flush with the holder surface 22 with clearance between the lower piston end 64 and the channel end 38.

The piston 20 has an O-ring groove 66 located near the lower end of the piston 20. The O-ring groove 66 is formed facing the side of the channel wall 36 opposite from the O-ring 42. An O-ring 68 is carried in the O-ring groove 66 and moves with the piston 20. The two O-rings 42, 68 carried in the O-ring grooves 40, 66 form a substantially fluid-tight seal between the piston 20 and the channel wall 36.

The holder block assembly 10 is assembled by inserting the sleeve shank 52 into the holder block hole 22 and driving the sleeve 16 against the holder block 10 until the flange surface 56 butts against the holder block surface 22. When the sleeve 16 is fully inserted into the holder block 10, the piston 20 is captured in the piston channel 34 between the flange surface 56 and the closed piston channel end 38. The holder block wall surface sections 32 and the shank surface sections 60 cooperate to form sets of interference fits between respective facing pairs of sections 32, 60 that resist relative separation and rotation of the holder block 14 and the sleeve 16.

When it becomes necessary to replace the sleeve 16, a source of high-pressure hydraulic fluid (for example, oil, a water/oil emulsion, or other fluid as is known in the art) is connected to the inlet portion 46 of the flow line 44. This provides hydraulic pressure into the piston channel 34 between the piston 20 and the closed end 38 of the piston channel. The pressurized fluid in the piston channel 34 applies a fluid force against the lower end of the piston 20, moving the piston 20 axially towards the open end of the channel 34 and forcing the piston 20 to engage and press against the sleeve flange surface 56. The piston 20 transmits the fluid force to the sleeve 16 in a direction parallel to the axis 28, urging the sleeve shank 52 out of the holder block hole 22. The hydraulic pressure is sufficient to overcome the frictional resistance of the interference fits, thereby extracting the sleeve 16 from the holder block 14.

For extraction, the sleeve 16 needs to move axially only the distance necessary for the adjacent pairs of surface sections 32, 60 to move across each other and lose interference fit. The piston 20 has an axial length that is substantially greater than the axial length of any of the surface sections 32, 60. In this way the piston 20 extends only partially out of the piston channel 34 when the interference fits are released and the sleeve 16 is no longer gripped by the holder block 14. This is the condition of the holder block assembly 10 as shown in FIG. 1.

Preferably the axial length of the piston 20 is at least twice the axial length of any of the surface sections 32, 60 to assure that the piston 20 is retained in the piston channel 34 when the sleeve 16 is released from the grip of the holder block 14.

The piston O-ring 68 is also spaced from the top of the piston 20 a distance substantially greater than the axial length of any of the surface sections 32, 60. The hydraulic seal between the piston 20 and the piston channel wall 36 is maintained even up to the point that the sleeve 16 is released from the grip of the holder block 14. Hydraulic fluid is not released from the piston channel 34. Tooling or a jig can be applied to the holder assembly 10 prior to applying the hydraulic pressure to limit maximum axial displacement of the sleeve 16 during extraction so that the hydraulic seal between the piston 20 and the piston channel wall 36 is not inadvertently lost.

The illustrated holder block assembly 10 is a "dry" assembly, that is, the holder block assembly 10 does not include features that provide for spraying water on the cutter bit. The present invention can be readily adapted to holder block assemblies that are capable of spraying water on the cutter bit as are known in the art.

The illustrated structure for forming a substantially fluid-tight seal between the piston 20 and the piston channel wall 36 can be replaced with equivalent sealing structures known to those of ordinary skill in the art. For example, the piston 20 could carry both O-rings, or the holder block 14 could carry both O-rings.

While I have illustrated and described a preferred embodiment of my invention, I do not wish to be limited to the precise details set forth, but desire to avail myself of such changes and alterations as fall within the purview of the following claims.

The invention claimed is:

1. An assembly comprising:

a holder block, a sleeve, and a piston;

the holder block comprising a first hole extending along an axis, a wall surrounding the first hole, a piston channel, and a bore in fluid communication with the piston channel, the first hole to receive the sleeve;

the sleeve comprising a shank and a second hole for receiving a cutter bit, the shank receivable in the first hole of the holder block;

the sleeve and the holder block each comprising a peripheral surface facing the other of the sleeve and the holder block when the holder block receives the sleeve;

the piston channel having an opening in the peripheral surface of the holder block, the piston channel extending axially inwardly from the opening into the holder block to an end of the piston channel;

the piston in the piston channel, the piston axially movable in the piston channel;

the bore in fluid communication with the end of the piston channel wherein when a source of pressurized hydraulic fluid is applied to the end of the piston channel through the bore, the fluid pressure urges the piston away from the end of the piston channel.

2. The assembly of claim 1 wherein the piston is an annular piston and the piston channel is an annular channel.

3. The assembly of claim 1 wherein the piston channel surrounds the first hole.

4. The assembly of claim 1 wherein the piston has an axial length, the sleeve shank and the holder block wall each have a forward end and a plurality of axially adjacent surface sections that each have an axial length and become successively smaller in cross-section in a direction away from the front end, and the axial length of the piston is greater than the axial length of any of the surface sections.

5. The assembly of claim 4 wherein the axial length of the piston is greater than twice the axial length of any of the surface sections.

6. The assembly of claim 4 wherein:

the piston has an upper end adjacent the piston channel opening;

the holder block comprises a second wall defining the piston channel;

an O-ring is attached to the piston and forms a substantially fluid-tight seal between the piston and the second wall, the O-ring axially spaced from the upper end of the piston a distance greater than the axial length of any of the surface sections.

7. The assembly of claim 1 wherein a second wall surrounds the piston channel and comprising means for forming a substantially fluid-tight seal between the piston and the second wall.

8. The assembly of claim 7 wherein the seal means comprises an O-ring attached to the piston for conjoint movement with the piston.

9. The assembly of claim 7 wherein the seal means comprises an O-ring attached to the holder block.

10. The assembly of claim 1 wherein the sleeve comprises an enlarged flange at an end of the shank, the peripheral surface of the sleeve on the flange.

11. The assembly of claim 10 wherein the piston is an annular piston that faces the flange when the sleeve is in the holder.

12. The assembly of claim 11 wherein the annular piston has a radial thickness and an axial length, the length greater than the thickness.

13. The assembly of claim 1 wherein the bore has a portion extending from the piston channel into the holder, the bore portion parallel with the axis.

14. The assembly of claim 1 wherein the assembly includes only one piston.

15. A cutting drum comprising a plurality of assemblies as defined in claim 1.

16. A mining machine comprising the cutting drum defined in claim 15.

17. A method of extracting a sleeve held in a hole of a holder block, the sleeve configured to hold a cutter bit, the method comprising the steps of:

(a) providing a piston in the holder block, the piston movable in a first direction to extend at least partially out of the holder block whereby the piston engages the sleeve held in the holder block and transmits a force to the sleeve in the first direction urging the sleeve out of the holder block;

(b) applying a fluid force to the piston urging the piston in the first direction and against the sleeve, the piston transmitting a sufficient amount of the fluid force to the sleeve to move the sleeve away from the holder block;

(c) moving the piston against the sleeve a sufficient distance to release the sleeve from the holder block.

18. The method of claim 17 wherein the piston has an axial length and the sleeve moves away from the holder block a distance less than the length of the piston to release the sleeve from the holder block.

19. The method of claim 18 wherein the sleeve is held in the holder block by an interference fit, and step (b) comprises the step of:

(d) transmitting a sufficient amount of fluid force from the piston to the sleeve to overcome frictional resistance of the interference fit.

* * * * *